US011609027B2

(12) United States Patent
Barta et al.

(10) Patent No.: US 11,609,027 B2
(45) Date of Patent: Mar. 21, 2023

(54) CONTROL METHOD FOR VAPOR COMPRESSION CYCLE

(71) Applicant: Purdue Research Foundation, West Lafayette, IN (US)

(72) Inventors: Riley B Barta, West Lafayette, IN (US); Eckhard Achim Groll, West Lafayette, IN (US); Davide Ziviani, West Lafayette, IN (US); Florian Simon, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 53 days.

(21) Appl. No.: 17/111,548

(22) Filed: Dec. 4, 2020

(65) Prior Publication Data

US 2021/0180835 A1 Jun. 17, 2021

Related U.S. Application Data

(60) Provisional application No. 62/946,448, filed on Dec. 11, 2019.

(51) Int. Cl.
*F25B 49/02* (2006.01)
*F25B 11/02* (2006.01)
(Continued)

(52) U.S. Cl.
CPC ..... *F25B 11/02* (2013.01); *F25B 30/02* (2013.01); *F25B 40/06* (2013.01); *F25B 49/022* (2013.01);
(Continued)

(58) Field of Classification Search
CPC ..... F25B 11/02; F25B 11/04; F25B 40/06; F25B 49/022; F25B 2313/0293; F25B 2313/0294; F25B 2400/0409; F25B 2400/14; F25B 2400/23; F25B 2500/26; F25B 2500/28
See application file for complete search history.

(56) References Cited

U.S. PATENT DOCUMENTS 5,722,255 A * 3/1998 Brasz ..... F04C 19/007 62/50.3
2014/0150489 A1* 6/2014 Gan ..... F25D 17/06 62/428

OTHER PUBLICATIONS

Barta, R., et al.,Experimental Analyses of Different Control Strategies of an R-410A Split-System Heat Pump by Employing a Turbomachinery Expansion Recovery Device. International Journal of Refrigeration vol. 112, Apr. 2020, pp. 189-200.
(Continued)

*Primary Examiner* — Jonathan Bradford
(74) *Attorney, Agent, or Firm* — Purdue Research Foundation

(57) ABSTRACT

A method for operating and controlling a vapor-compression cycle includes providing a system comprising an evaporator with a fan, a compressor, a condenser with a fan, an integrated expander, and a flash tank device with a vapor/liquid two-phase inlet and two outlets wherein a first outlet is a vapor outlet and a second outlet is a liquid outlet, and a metering valve; bringing a vapor-compression cycle up to steady-state at a fixed operating condition; opening the metering valve until the desired compressor suction superheat is achieved; and maintaining the desired degree of superheat by selectively increasing and decreasing superheat by reducing and increasing metering valve flow rate respectively.

5 Claims, 9 Drawing Sheets

(51) Int. Cl.
*F25B 30/02* (2006.01)
*F25B 40/06* (2006.01)

(52) U.S. Cl.
CPC ..... *F25B 2313/0293* (2013.01); *F25B 2313/0294* (2013.01); *F25B 2400/0409* (2013.01); *F25B 2400/14* (2013.01); *F25B 2400/23* (2013.01); *F25B 2500/26* (2013.01); *F25B 2500/28* (2013.01); *F25B 2600/2501* (2013.01); *F25B 2700/2101* (2013.01)

(56) References Cited

OTHER PUBLICATIONS

Barta, R., et al., Experimental Analysis and Design Improvements on Combined Viper Expansion Work Recovery Turbine and Flow Phase Separation Device Applied in R410A Heat Pump, 17th International Refrigeration and Air Conditioning Conference at Purdue, Jul. 9-12, 2018.

* cited by examiner

CONTROL METHOD FOR VAPOR COMPRESSION CYCLE

CROSS-REFERENCE TO RELATED APPLICATION

This application claims the priority benefit of U.S. Provisional Patent Application No. 62/946,448, filed Dec. 11, 2019, which is incorporated herein by reference in its entirety.

TECHNICAL FIELD

The present disclosure relates to a novel method for operating and controlling a vapor-compression cycle.

BACKGROUND

This section introduces aspects that may help facilitate a better understanding of the disclosure. Accordingly, these statements are to be read in this light and are not to be understood as admissions about what is or is not prior art.

With increasing demand for high-efficiency vapor-compression cycles (VCCs), each aspect of the conventional four component VCC, i.e. a compressor, condenser, expansion valve, and evaporator, is being considered for potential performance improvements. As such, several solutions for harnessing the energy released from refrigerants during the throttling process of a conventional VCC have been investigated to increase the overall cycle efficiency. These devices are referred to as expansion work recovery devices. While the introduction of these devices leads to higher system performance due to expansion work recovery and increased cooling capacity, the primary purpose of an expansion device is controlling the expansion process of a VCC.

Several strategies regarding modification of the expansion process are becoming increasingly common to help improve the efficiency of VCCs. One such strategy is applying an ejector, which converts the high-pressure refrigerant into a high velocity motive stream that then entrains the flow from the outlet of the evaporator into a mixing chamber before exiting through a diffuser. This results in a higher compressor suction pressure, thus decreasing the necessary input work.

Alternatively, directly harvesting the energy available during the expansion process can be done using an expander. This is done by expanding the fluid through a process that is between isenthalpic and isentropic. This performance is quantified by the isentropic efficiency of the expander and has the combined benefit of decreasing the net power consumed by the system and decreasing the inlet quality to the evaporator.

Nowadays the majority of VCCs in production, especially those utilizing hydrofluorocarbon (HFC) refrigerants such as R-410A, employ either a thermostatic expansion valve (TXV) or an electronic expansion valve (EXV) to control the expansion process. However, a combination of controllability of current expansion methods with high-efficiency expansion work recovery methods are not known. Therefore, a novel method for operating and controlling a vapor-compression cycle for the combined advantages is still needed.

SUMMARY

The present disclosure relates to a novel method for operating and controlling a vapor-compression cycle.

In one embodiment, the present disclosure provides a method for operating and controlling a vapor-compression cycle, wherein the method comprises:

- providing a system comprising an evaporator with a fan, an inlet and an outlet; a compressor with an inlet and an outlet; a condenser with a fan, an inlet and an outlet; an integrated expander and flash tank device with a vapor/liquid two-phase inlet, a first vapor outlet, and a second liquid outlet; and a metering valve with an inlet and an outlet, wherein the metering valve is disposed between the vapor outlet of the integrated expander and flash tank device, the inlet of the compressor, and the outlet of the evaporator;
- bringing a vapor-compression cycle up to steady-state at a fixed operating condition by first turning on the evaporator fan, then turning on the compressor, and the condenser fan, and keeping the metering valve closed, wherein the steady-state is determined by evaporator and condenser air outlet temperature variations of not greater than 1.1° C.;
- beginning to open the metering valve to bypass vapor from the flash tank of the integrated expander and flash tank device towards the inlet of the compressor;
- continuing to open the metering valve until a desired compressor suction superheat is achieved; and
- increasing superheat by reducing metering valve flow rate and decreasing superheat by increasing metering valve flow rate to allow active control of the system.

DETAILED DESCRIPTION

Figure 1:
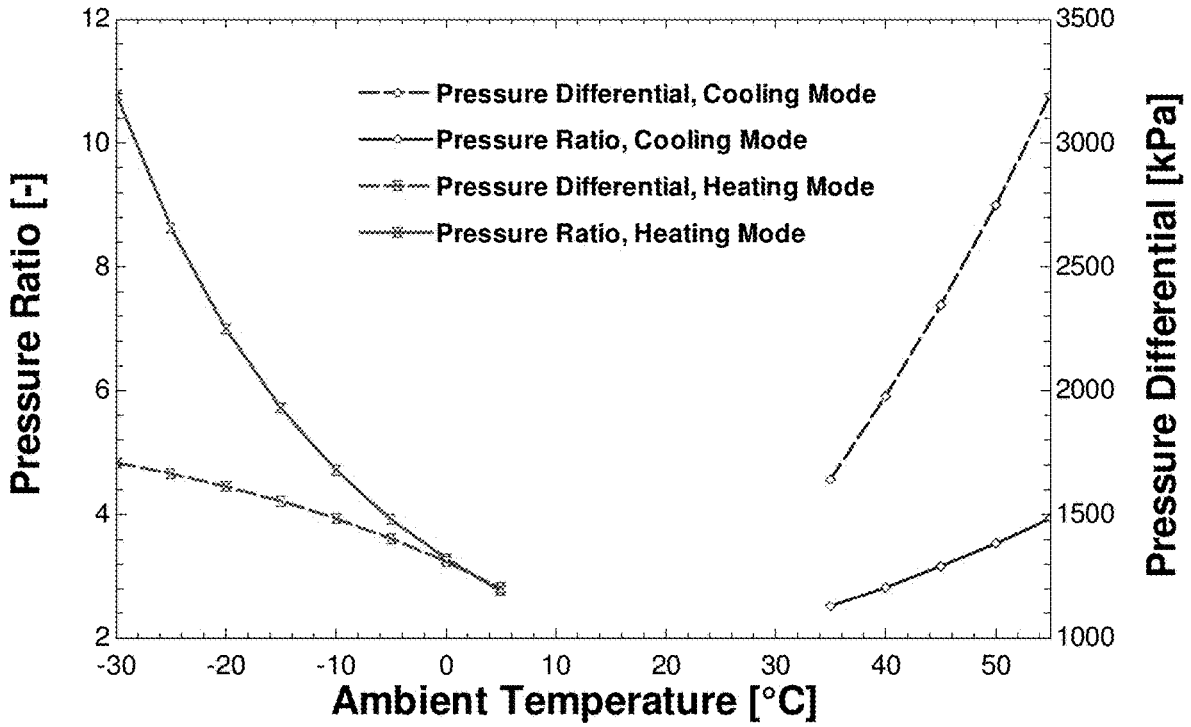
FIG. 1 illustrates expander pressure ratio and pressure differential variation with ambient temperature.

For the purposes of promoting an understanding of the principles of the present disclosure, reference will now be made to embodiments illustrated in drawings, and specific language will be used to describe the same. It will nevertheless be understood that no limitation of the scope of this disclosure is thereby intended.

In the present disclosure the term "about" can allow for a degree of variability in a value or range, for example, within 10%, within 5%, or within 1% of a stated value or of a stated limit of a range.

In the present disclosure the term "substantially" can allow for a degree of variability in a value or range, for example, within 90%, within 95%, or within 99% of a stated value or of a stated limit of a range.

In one embodiment, the present disclosure provides a method for operating and controlling a vapor-compression cycle, wherein the method comprises:

providing a system comprising an evaporator with a fan, an inlet and an outlet; a compressor with an inlet and an outlet; a condenser with a fan, an inlet and an outlet; an integrated expander and flash tank device with a vapor/liquid two-phase inlet, a first vapor outlet, and a second liquid outlet; and a metering valve with an inlet and an outlet, wherein the metering valve is disposed between the vapor outlet of the integrated expander and flash tank device, the inlet of the compressor, and the outlet of the evaporator;

bringing a vapor-compression cycle up to steady-state at a fixed operating condition by first turning on the evaporator fan, then turning on the compressor, and the condenser fan, and keeping the metering valve closed, wherein the steady-state is determined by evaporator and condenser air outlet temperature variations of not greater than 1.1° C.;

beginning to open the metering valve to bypass vapor from the flash tank of the integrated expander and flash tank device towards the inlet of the compressor;

continuing to open the metering valve until a desired compressor suction superheat is achieved; and increasing superheat by reducing metering valve flow rate and decreasing superheat by increasing metering valve flow rate to allow active control of the system.

In one embodiment regarding the method for operating and controlling a vapor-compression cycle, wherein an optional heater is provided following the metering valve to ensure compressor suction superheat.

In one embodiment regarding the method for operating and controlling a vapor-compression cycle, wherein the evaporator is a turbine-based evaporator. In one aspect, the turbine is a radial-in axial-out turbine.

In one embodiment regarding the method for operating and controlling a vapor-compression cycle, wherein is to provide:

decreased compressor suction superheat as the vapor from the vapor outlet mixes with superheated vapor from the outlet of the evaporator;

decreased liquid outlet quality from the liquid outlet of the flash tank into the evaporator to allow increasing specific enthalpy across the evaporator, decreasing pressure drop and refrigerant maldistribution through the evaporator distributor, and increasing heat flux for two phase evaporation in the evaporator; and increased turbine-based expander power output; and reduced friction on the turbine to facilitate the increased rotational velocity and power output.

1. THEORETICAL METHODOLOGY

1.1 Heat Pump Model Overview

An overview of the modeling conducted to determine the heat pump operating mode that would maximize the system COP from the use of an expander is provided. This analysis provides direction as to which mode the expander should be tested in to achieve maximum COP benefit during the experimental portion of this work. The heat pump model utilized in this analysis was a 4-component VCC made up of a single-stage compressor, a condenser, an expander, and an evaporator. A steady-state model of an R-410A heat pump in both cooling and heating mode was developed using Engineering Equation Solver (EES). See Klein, S., 2019. Engineering Equation Solver. F-Chart Software. Version 10.268. Model operating parameters and assumptions can be found in Table 1.

TABLE 1

Model operating parameters and assumptions

| Parameter | Units | Value |
|---|---|---|
| Ambient Temperature Range (Cooling Mode) | ° C. | 35 to 55 |
| Ambient Temperature Range (Heating Mode) | ° C. | −30 to 5 |
| Indoor Temperature | ° C. | 20 |
| Capacity | kW | 17.58 |
| Compressor Suction Superheat | ° C. | 5 |
| Condenser Outlet Subcool | ° C. | 5 |
| Heat Exchanger Pinch | ° C. | 5 |
| Compressor Isentropic Efficiency | % | 70 |
| Expander Isentropic Efficiency | % | 50 |

In this model, the capacity and compressor isentropic efficiency are held constant for all ambient temperatures. Therefore, it is assumed that the compressor is a variable speed compressor and the model neglects variation of isentropic and volumetric efficiency of the compressor over the range of temperatures analyzed. Compressor and expander isentropic efficiency are calculated with Equations 1 and 2, respectively. Losses due to heat, mechanical and motor inefficiencies are neglected in this analysis.

$$\eta_{is,Comp} = \frac{h_{2s} - h_1}{h_2 - h_1} \quad [1]$$

$$\eta_{is,Exp} = \frac{h_4 - h_3}{h_{4s} - h_3} \quad [2]$$

The system performance is quantified by COP, and the calculations of this value in cooling and heating mode are shown by Equations 3 and 4, respectively.

$$COP_{Cooling} = \frac{\dot{Q}_{Evap}}{\dot{W}_{Comp} - \dot{W}_{Exp}} \quad [3]$$

$$COP_{Heating} = \frac{\dot{Q}_{Cond}}{\dot{W}_{Comp} - \dot{W}_{Exp}} \quad [4]$$

In order to calculate the COP improvement resulting from the inclusion of the expander, the model was initially run to obtain a baseline performance with an isenthalpic expansion process as would be found with a TXV. After a parametric study of the heat pump system COP over a range of ambient temperatures was run, the expander was added to the model and the COP parametric study was repeated and compared to baseline.

1.2 Assessment of Expander Benefit in Heating and Cooling Modes

When looking at potential for work recovery in an expansion process, large pressure ratios, pressure differentials, and mass flow rates are considered to be directly related to increasing potential for work recovery. The pressure ratios and pressure differentials contribute to the specific potential energy to harvest, and the mass flow rate acts as a coefficient that scales the effects of the change in specific enthalpy. Therefore, the effects of these three parameters were analyzed over a range of temperatures in both cooling and heating modes. FIG. 1 shows the results of the model in terms of pressure ratio and pressure differential through the expander for the range of ambient temperatures assessed at a constant indoor temperature.

Figure 2:
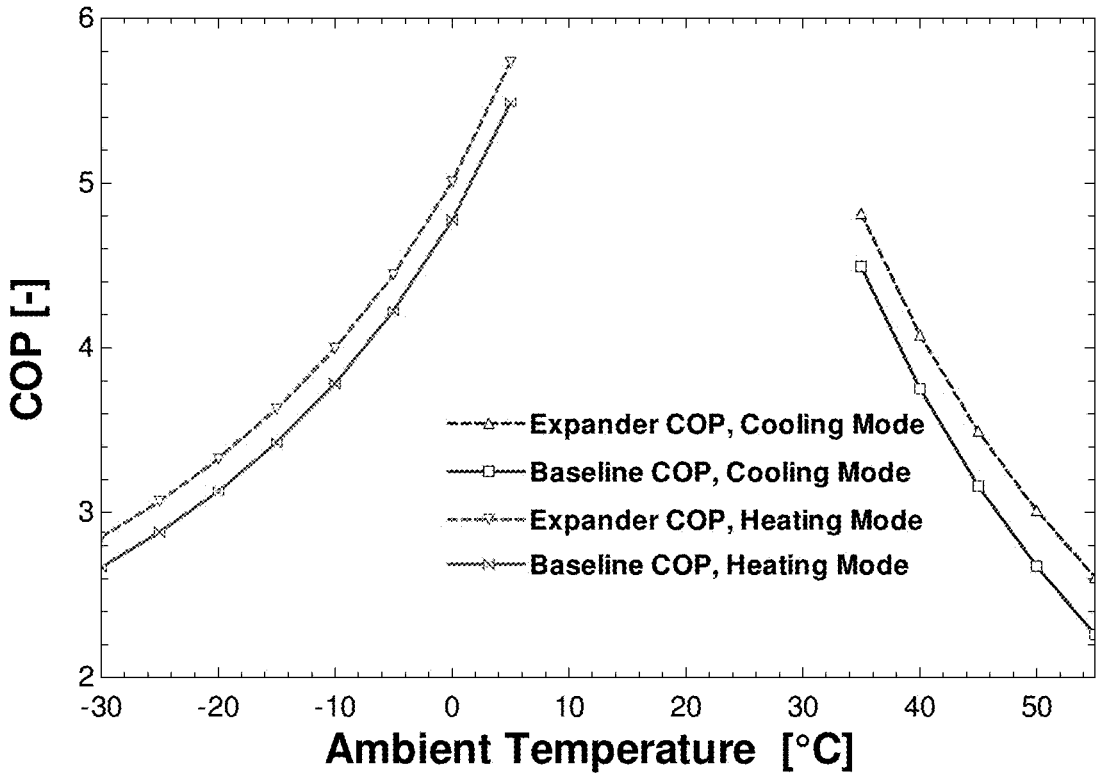
FIG. 2 illustrates Coefficient of Performance (COP) vs. Ambient temperature.

Lower temperatures for both evaporation and condensation are associated with operating a heat pump in heating mode due to lower source and sink temperatures, respectively. These lower temperatures result in lower system pressures throughout, both for evaporation and condensation. In turn, the lower system pressures lead to a maximum pressure ratio between condensation and evaporation in heating mode that is nearly three times larger than the system pressure ratio in cooling mode. Despite the larger pressure ratios in heating mode, the pressure differential values provided in FIG. 1 show that the pressure differential across the expansion is larger for the cooling mode. A plot showing the COP values using the expander as well as the baseline system with a TXV in both cooling and heating modes is provided in FIG. 2. The percentage improvement in COP over the baseline system is provided in Table 2. These results show that the expander would have a more positive impact on the cycle COP in cooling mode than in heating mode. This statement is supported by obtaining simulated COP improvements from 4.5% to 6.9% and 7.2% to 15.3% in heating and cooling modes, respectively. Thus, the decision to operate the R-410A expander in cooling mode was validated.

TABLE 2

COP percentage improvement due to expander over basic 4-component VCC

| Operating Mode (-) | Ambient Temperature (° C.) | COP Improvement (%) |
|---|---|---|
| Heating | −30 | 6.9 |
| | −25 | 6.6 |
| | −20 | 6.3 |
| | −15 | 5.9 |
| | −10 | 5.6 |
| | −5 | 5.2 |
| | 0 | 4.9 |
| | 5 | 4.5 |
| Cooling | 35 | 7.2 |
| | 40 | 8.7 |
| | 45 | 10.5 |
| | 50 | 12.7 |
| | 55 | 15.3 |

2. EXPERIMENTAL METHODOLOGY

This portion of the disclosure summarizes the experimental setup utilized to test both proposed control methodologies and describes each control method in detail. The aim of these experiments is to assess the ability of the proposed control strategy of an expander to control a VCC while also recovering work from the expansion process. A fixed nozzle device was developed that implemented phase separation to increase both expander isentropic efficiency and COP benefit to the system. This second device utilized a radial-in axial-out turbine and employed phase separation that allowed a vapor bypass around the evaporator for compressor suction superheat control.

2.1 Heat Pump Experimental Setup

Figure 3:
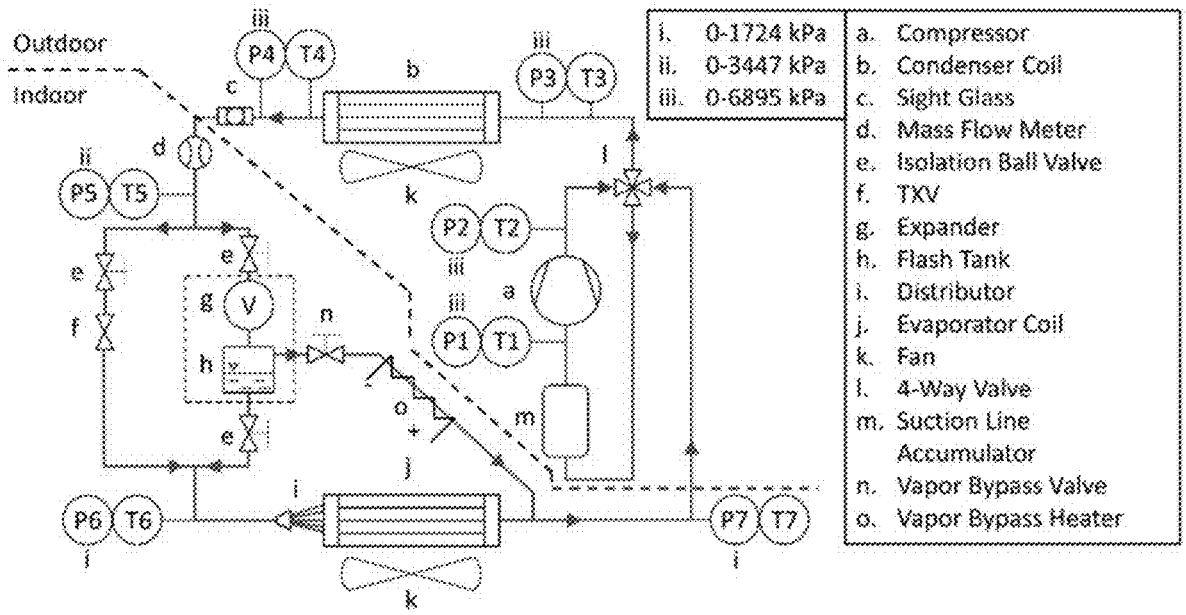
FIG. 3 illustrates schematic of R-410A heat pump test setup.

The expander under investigation has been developed for an R-410A residential heat pump that was installed in a side-by-side psychrometric chamber. A schematic of the 4-component heat pump in the psychrometric chambers is shown in FIG. 3. The mass flow rate through the system was measured in the liquid line. The locations for all measurement points on the heat pump schematic are identified in FIG. 3, and the details of the type, range, and uncertainty of all measurement devices utilized in this setup are listed in Table 3. Additionally, the full-scale (FS) ranges of the pressure transducers utilized are shown in FIG. 3. Temperature measurements were made by T-Type thermocouples placed in-line with the refrigerant flow to maximize accuracy. The equation used to calculate the propagation of uncertainty throughout a given calculation is given by Equation 5 from Taylor and Kuyatt. See Taylor, B. N., Kuyatt, C. E., 1994. NIST Technical Note 1297 1994 Edition, Guidelines for Evaluating and Expressing the Uncertainty of NIST Measurement Results. Natl. Inst. Stand. Technol. 1-20.

$$U_Y = \sqrt{\sum\left(\frac{\partial Y}{\partial X_i} U_{x_i}\right)^2} \quad [5]$$

where U is the uncertainty, Y is the calculated quantity, and X is the measured quantity.

Figure 4:
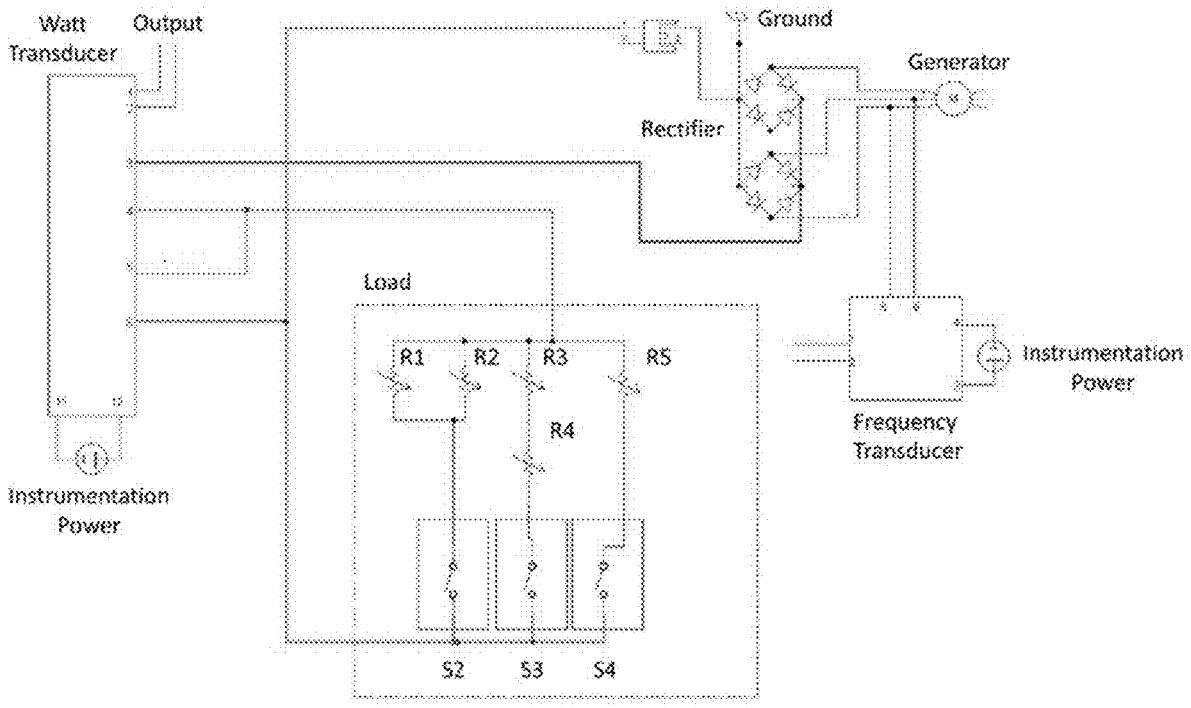
FIG. 4 illustrates expander generator loading and power measurement diagram.

The power consumption of the indoor fan and outdoor unit, consisting of both the compressor and outdoor fan, was measured with two independent watt transducers. The AC power output from the expander was rectified to DC power, and then fed through a variable resistance bank before reaching its own power monitor. The AC power was fed to a frequency transducer before rectification. A variable resistance bank was utilized to simulate the loading of the generator by either a fan motor or a system light, and the resistance used was measured by hand using an ohmmeter. While the resistor bank did heat up during testing, variation in resistance was checked before and after tests and was found to be less than 1 Ohm. Therefore, it was recorded as constant. The power measurements with the variable nozzle testing and the 2.29 mm nozzle testing of the vapor bypass design were conducted with a power meter that had too large of a range to provide meaningful power measurements. This was amended in further testing through the use of a power measurement device with a range that was 8 times smaller than the initial meter. The power monitor used 2.29 mm nozzle tests used a watt multiplier principal and had a full scale that made the absolute uncertainty of the power measurement large relative to the power levels measured. However, the measured power levels were still above minimum measurable values for this power meter. The watt multiplier utilizes a low-resistance shunt resistor to convert the current output from the device into a millivolt value. This voltage output is then divided by the shunt resistance via Ohm's Law to reach current, which is then multiplied by the nominal input voltage from the generator to achieve power. This is the same multiplier principal used in residential home utility monitoring. However, due to the multiplier having too large of a full scale power measurement value for the generator output, this power monitor was updated to a smaller power transducer to provide meaningful accuracy for all but one, the 2.29 mm test, of the evaporator bypass results in the testing of the vapor bypass expander iteration. An electrical diagram explaining the power path from the expander to the frequency transducer, variable resistors, and power transducer is shown in FIG. 4.

TABLE 3

R-410A heat pump instrumentation.

| Physical Parameter | Instrument | Range | Uncertainty |
|---|---|---|---|
| In-Line Temperature | T-Type Thermocouple | −200-400° C. | ±0.5° C. |
| Refrigerant Pressure | Pressure Transducer | 0-1724, 0-3447, 0-6895 kPa | ±0.5% FS |
| Refrigerant Flow Rate | Coriolis Flow Meter | 0-755 g $s^{-1}$ | ±0.2% FS |
| Unit Indoor Power | Power Transducer | 0-1 kW | ±0.04% FS |
| Unit Outdoor Power | Current Transformer | 100:5 CR | ±1.5% FS |
| | Power Transducer | 0-20 kW | ±0.04% FS |
| Expander Power - Variable Nozzle | Watt Multiplier | 0-50 mV, 0-400 V, 0-2 kW | ±0.5% FS |
| Expander Power - Evaporator Bypass | Watt Transducer | 0-400 V, 0-250 W | ±0.5% FS |
| Expander Frequency | Frequency Transducer | 0-1 kHz, 3-575 V | ±0.05% Rdg, ±0.05% Span |
| Resistance | Ohmmeter | 0-600 Ω | ±0.9% ± 1.0 Ω |
| Air Flow Rate | ASHRAE Nozzle Box | 2188-5107 $m^3h^{-1}$ | ±6.66 $m^3$ $h^{-1}$ |
| Air Dew Point | General Eastern D-2 Hygrometer Chilled Mirror | −20-85° C., 0-95% | ±0.2 ° C. |
| Atmospheric Pressure | Pressure Transducer | 80-110 kPa | ±0.03 kPa |

A summary of test conditions used to test the expander are provided in Table 4, one of which is a standard condition in ANSI/AHRI. See Performance Rating of Unitary Air-conditioning & Air-source Heat Pump Equipment with Addendum 1. ANSI/AHRI (2008). Specifically, Test Condition A from this standard was used because it has the largest available expansion work of all the test conditions in this standard. The cycle began under TXV operation to establish system operation before engaging the expander. To ensure comparable system charges, the heat pump was operated in TXV mode once the psychrometric chambers reached target test conditions Next, subcool was compared to TXV testing preceding the expander testing proposed for comparison. If the subcool values were within 0.5° C., the charge was considered comparable.

TABLE 4

Expander test matrix

| Control | Test | Indoor | | Outdoor | |
|---|---|---|---|---|---|
| Method (-) | Designation (-) | Temperature (° C.) | RH (%) | Temperature (° C.) | RH (%) |
| Variable Nozzle | A | 26.7 | 51.1 | 35.0 | 39.8 |
| Evaporator Bypass | 1E | 26.7 | 51.1 | 29.4 | 39.8 |
| | 2E | 26.7 | 51.1 | 32.2 | 39.8 |
| | 3E | 26.7 | 51.1 | 35.0 | 39.8 |
| | 4E | 26.7 | 51.1 | 37.8 | 39.8 |
| | 5E | 26.7 | 51.1 | 40.6 | 39.8 |
| | A | 26.7 | 51.1 | 35.0 | 39.8 |

2.2 Flash Tank and Evaporator Bypass Line Design Overview

Figure 5:
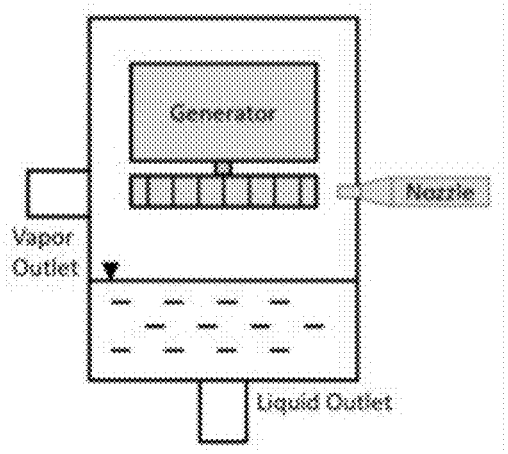
FIG. 5 illustrates modified expander housing.
Figure 6:
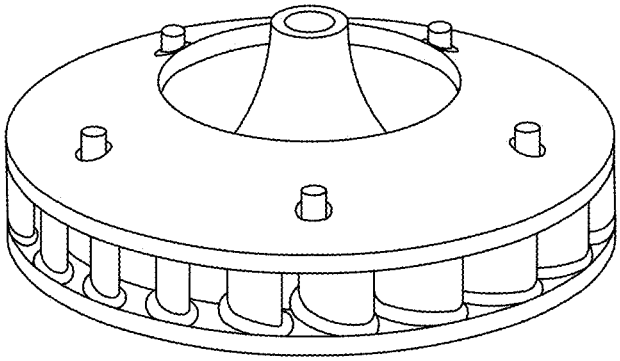
FIG. 6 illustrates a rendering of the radial-in axial-out turbine.

The initial expander housing required modification to implement the desired phase separation capability. In particular, an additional outlet near the top of the housing was added in order to allow the vapor to exit the housing separate from the liquid. Also, the height of the housing was increased to allow liquid to separate from the turbine more quickly to reduce friction. A schematic of the modified housing is shown in FIG. 5. Additionally, a rendering of the radial-in axial-out turbine is shown in FIG. 6, which was the turbine geometry utilized for all of the evaporator-bypass testing. The liquid outlet from the bottom of the housing was fed to the evaporator inlet distributor. The vapor line was connected to the evaporator outlet with a metering valve installed in this line, thus creating a controllable evaporator bypass for the vapor flow. The vapor bypass valve allowed for a maximum of 9.5 turns of its handle, corresponding to a volumetric flow rate increase of 0.68 $m^3h^{-1}$ per turn. The flow coefficient $k_v$ of the valve increases at a rate of 0.33 $m^3h^{-1}$ of water through a valve at 16° C. with a pressure drop of 100 kPa per turn. This modification is shown schematically in FIG. 3, with dotted lines surrounding both the expander and the flash tank to denote that both of these components are within one device. A 576 W heater was added on the bypass to ensure compressor suction superheat. The evaporator bypass mixes with the outlet of the evaporator within 0.3 m of the indoor unit, and is therefore located in the indoor psychrometric chamber. This bypass and phase separation effectively added flash tank phase separation abilities to the expander, thus providing additional potential for COP benefit and control. This additional benefit stems from the saturated liquid or low-quality two-phase flow from the bottom of the expander, which allows for a greater change in specific enthalpy across the evaporation process. In addition to this change, geometric analyses and other design changes were conducted and are summarized in-depth in Barta et al. See Barta, R. B., Simon, F., Groll, E. A., 2018. Experimental Analysis and Design Improvements on Combined Viper Expansion Work Recovery Turbine and Flow Phase Separation Device Applied in R410A Heat Pump. Proc. 17th Int. Refrig. Air Cond. Conf. Purdue Paper 2251. Fixed-geometry nozzles were implemented for the vapor bypass tests, as motivated by the previous results.

Motivation for this design is two-fold. First, the ability to control the flow rate of the vapor bypass line allows control of compressor suction superheat. Second, the flow rate of vapor directly affects the amount of separation that occurs within the housing. Therefore, the more vapor that is allowed to exit through a dedicated outlet, the more phase separation that occurs within the housing. This phase separation can then lead to quicker removal of liquid from the turbine, thus reducing friction and increasing power output.

3. RESULTS AND DISCUSSION

This portion of the work summarizes the experimental results from both proposed control strategies, and also provides a comparison between their respective performances.

3.1 Evaporator Bypass Results

Experimental results for this portion of the analysis were obtained according to the testing conditions outlined in Table 4 and will be referred to by test number herein. These results are grouped into three distinct efforts. The first is to understand the maximum COP benefit that can be obtained at a given condition while varying the generator load resistance. Next, both the resistance and vapor bypass valve position were varied to identify the combination that resulted in the maximum power output without compromising compressor suction superheat. The results of the first two tests provided a load resistance value that would result in maximum expander power output as well as an understanding of both cycle and expander behavior variation with vapor bypass valve modulation. These lessons motivated a parametric study over a range of outdoor conditions to assess variation of COP benefit and compressor suction superheat control utilizing the vapor bypass control method. COP is calculated using Equation 6.

$$COP = \frac{\dot{Q}_{Evap}}{\dot{W}_{Indoor} + \dot{W}_{Outdoor} - \dot{W}_{Exp}} \quad [6]$$

First, the straight nozzle with a 2.29 mm throat diameter was tested at Test Condition A to show the potential COP improvement of a fixed-diameter nozzle with this expander and to provide an example of the effects of generator resistance on performance. In order for this test to be meaningful, the compressor suction superheat should match that of the cycle under TXV operation, the charge should be held constant, and the evaporator cooling capacity refrigerant-side calculation should be within 6% of the air-side calculation. Furthermore, the COP calculation should consider the delivered cooling capacity, which should include the additional penalty of the indoor fan power addition to the airstream. To obtain this value, heat addition due to the indoor fan power should be added to the air flow that is rejecting heat to the refrigerant across the evaporator coil to accurately calculate the cooling of the air delivered to the conditioned space. Over this range of operating conditions, the suction superheat was an average of 4° C. lower in expander mode relative to the TXV mode. In order to provide a meaningful comparison, a superheat correction was imposed on the expander data to match that of the TXV test. The resulting increase in refrigerant side capacity from the superheat correction calculations was added to the airside delivered capacity value used for the COP calculation. Overall compressor isentropic efficiency is calculated for each test point and held constant during the correction, calculated with Equation 7.

$$n_{is,o} = \frac{\dot{m}(h_{2s} - h_1)}{\dot{W}_{Comp}} \quad [7]$$

Mass flow rate and compressor power consumption corrections are calculated with Equations 8 and 9, respectively, $$\frac{\dot{m}_{new}}{\dot{m}_{data}} = 1 + F\left(\frac{\rho_{suc,new}}{\rho_{suc,data}} - 1\right) \quad [8]$$

$$\frac{\dot{W}_{new}}{\dot{W}_{data}} = \frac{\dot{m}_{new}}{\dot{m}_{data}} \frac{\Delta h_{s,new}}{\Delta h_{s,data}} \quad [9]$$

where F is a correction factor assumed to be 0.75, suc denotes suction, new represents the corrected superheat state, data is the state from the experimental data, and s denotes the outlet state of an isentropic process.

The most significant additional uncertainty imparted on the results by the superheat correction was on the order of 140 W for the cooling capacity calculation. Additionally, the compressor power draw uncertainty was doubled from on the order of 8 W to 15 W. However, the vast majority of COP uncertainty is due to the airside measurements of cooling capacity, so these additional uncertainties do not have a significant effect on the overall validity of the results.

Figure 7:
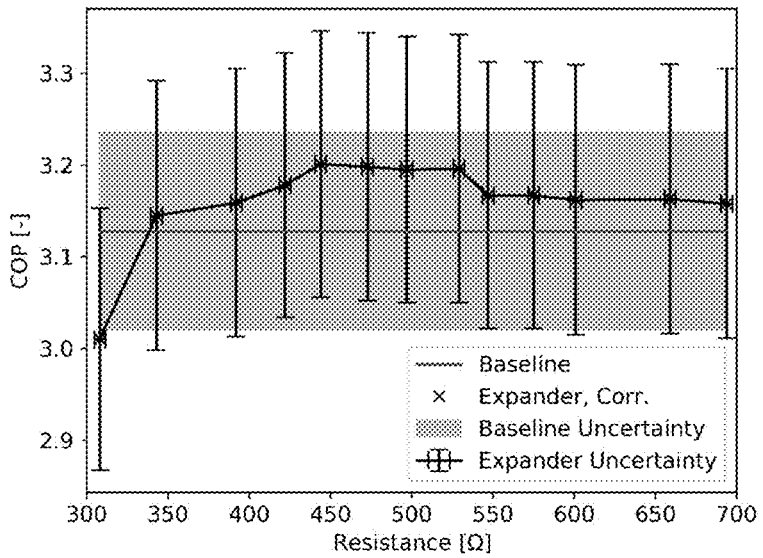
FIG. 7 illustrates effects of resistance variation using 2.29 mm straight nozzle on COP.

The system was operated with the manufacturer-specified TXV and no evaporator bypass across all of the same conditions that the expander was tested in to provide a meaningful baseline operation. A plot showing the system COP comparison between the 2.29 mm straight nozzle with superheat correction and the baseline TXV operation is provided in FIG. 7. This plot suggests that there is a range of resistances where the turbine balances power generation with phase separation such that the compressor suction superheat can remain above unsafe levels while also effectively harvesting energy. During these tests, the heater on the bypass line was set to the maximum power output when the expander was tested. As this heat could eventually be added to a circuit within the evaporator to superheat the bypass vapor, this heat was added to the cooling capacity used in the COP calculations for these results. Given that this would ultimately increase the cooling capacity for a given airflow rate, it is not anticipated that the fan power requirement to achieve the target nominal cooling capacity would increase. Furthermore, the vapor bypass valve was set to 2 turns from closed. After correcting for superheat, a maximum COP increase of 2.3% was achieved, and expander overall isentropic efficiency reached 18.8%, which also includes generator losses. The turbine rotational velocity increased from 3800 to 6000 RPM (revolutions per minute) with increases in resistance.

Figure 8:
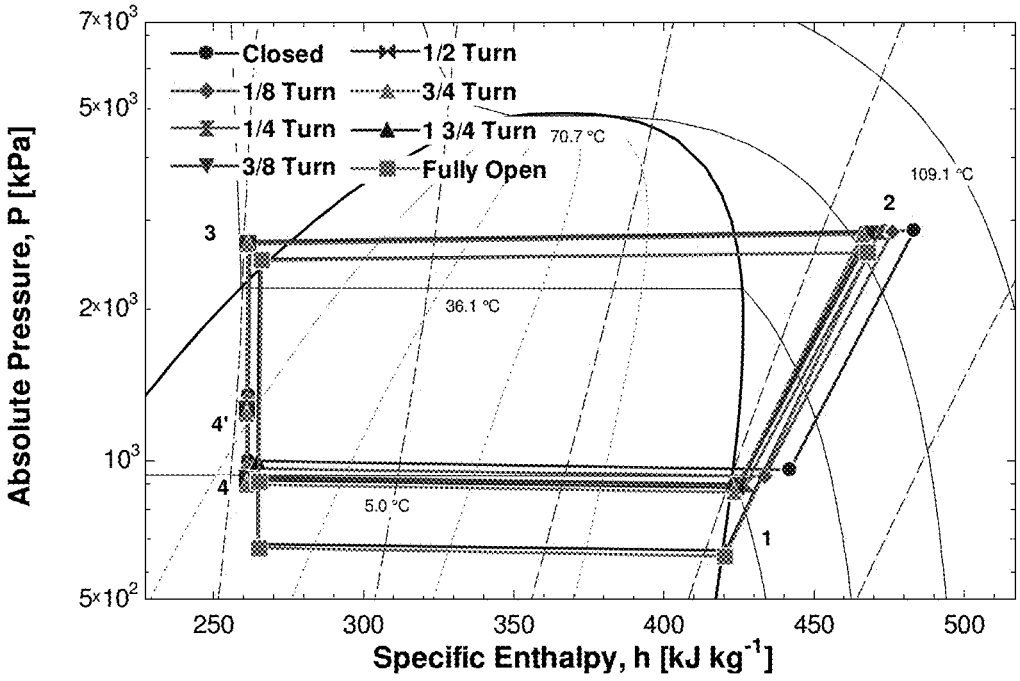
FIG. 8 illustrates P-h diagram of 2.03 mm straight nozzle showing cycle sensitivity to metering valve opening.

The next assessment was to understand how varying the vapor bypass line opening affected the cycle, and how the generator resistance could be varied in tandem with the vapor bypass line to maximize the benefit of these control methods. First, FIG. 8 shows the effects of metering valve position on the cycle at Test Condition A with a 2.03 mm straight nozzle. A smaller nozzle was utilized in an effort to increase controllability and better understand variation in performance over a range of valve positions. The simplified state point nomenclature to highlight key points is defined as follows. State 1 is compressor suction, State 2 is compressor discharge, State 3 is the expander inlet, State 4' is the evaporator distributor inlet, and State 4 is the evaporator inlet. Superheat is maintained at or above 3° C. for bypass valve positions from closed to ⅜ of a turn. Over this range power output was increased by 16.5% through opening the bypass valve from closed. Additionally, pressure drop across the distributor to the evaporator was decreased by over 5%, suggesting the lower-quality fluid exiting the bottom of the expander decreased the pressure drop in the distributor. The lower inlet quality can also achieve a higher two-phase convective heat transfer coefficient, thus increasing the potential for a more efficient heat exchanger. This trend is particularly true if applied to a microchannel heat exchanger, which becomes more feasible with the decrease in inlet quality provided by the phase separation. The change in output is given in relative terms instead of absolute because these results are the only vapor bypass results conducted with the oversized watt multiplier for power measurement from the variable nozzle testing. Therefore, the results are less meaningful when presented in absolute power output values. The pressure drop across the vapor line increased steadily until the suction superheat disappeared at positions past ⅜ of a turn. This suggests that there is a limit to the phase separation effectiveness for a given valve and operating condition, and once the limits of this range are reached the system will collapse into unsustainable operation.

Figure 9:
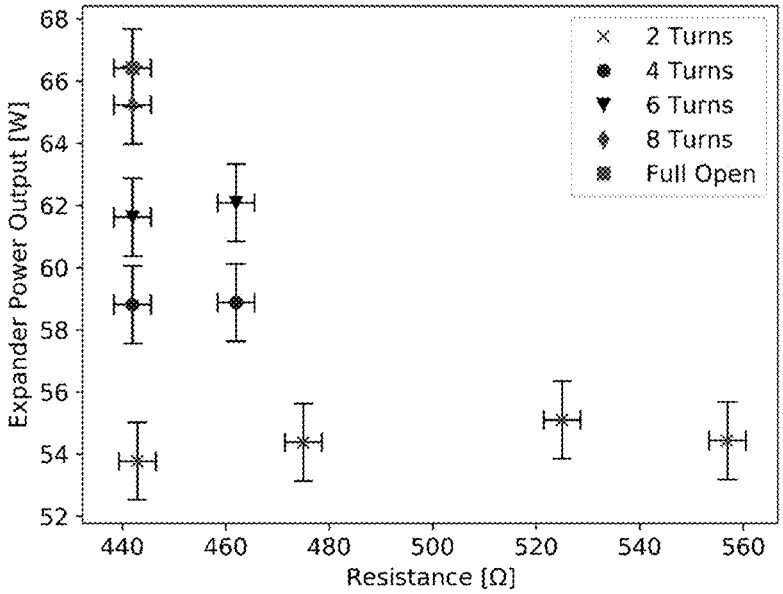
FIG. 9 illustrates power and phase separation sensitivity to bypass position and applied resistance using 2.03 mm straight nozzle.

To further investigate this observed range, a sweep of bypass line turns was conducted for various generator resistances with a 2.03 mm straight nozzle at Test Condition A. The turns were varied from 2 through to fully open, and resistance was swept over a range of values from 440 Ohms to 560 Ohms, which was a pre-determined range from previous tests. The results are shown in FIG. 9, representing the tests that resulted in compressor suction superheat over 3° C. As the number of turns increases, the range of values of resistance that result in adequate compressor suction superheat shrinks. Because the increased number of turns inherently pushes the compressor suction superheat closer to a saturated vapor state, the cycle must rely on more efficient phase separation within the expander to retain superheat at high-bypass flow rates. In parallel, there is a significant power benefit to be had from increasing the rate of vapor bypass. This observation is corroborated with a rise in power output from 54 W to 66 W with increasing valve turns at a fixed resistance, along with an increase in rotational velocity from 5000 to 5500 RPM. The results of having one resistance that can be isolated to safely allow this increase in power and bypass flow rate show that there is a target resistance of 440 Ohms with this particular design. This target resistance provides the best balance of power output and phase separation, facilitating maximum utilization of the bypass line flow rate variation. It should be noted that results shown in FIG. 8 and FIG. 9 were obtained using only the refrigerant-side measurements. Because the tests shown in FIG. 8 were focused on refrigerant-side behavior, there was no airside validation to calculate the phase separator outlet quality. Therefore, State 4 is calculated assuming isenthalpic expansion from State 4', thus representing a higher quality than would be exiting the bottom of the flash tank. Airside validated test results have shown outlet qualities as low as 0.025 from the bottom of the expander housing.

Given the above observations on the expander performance variation with nozzle size, metering valve opening, and generator resistance, an elliptical nozzle with a 1.65 mm throat diameter was selected to conduct a parametric study on the expander performance over a range of outdoor temperatures. The smaller diameter nozzle was chosen in order to facilitate a higher compressor superheat that would be more likely to match that of the TXV operation. The elliptical geometry was not prioritized, but chosen because it was the only nozzle with this target diameter available at the time of the test. This testing consisted of five tests, 1E through 5E in Table 4, and the airside energy balance was within 6% for four tests, and 7% for test 4E.

Figure 10:
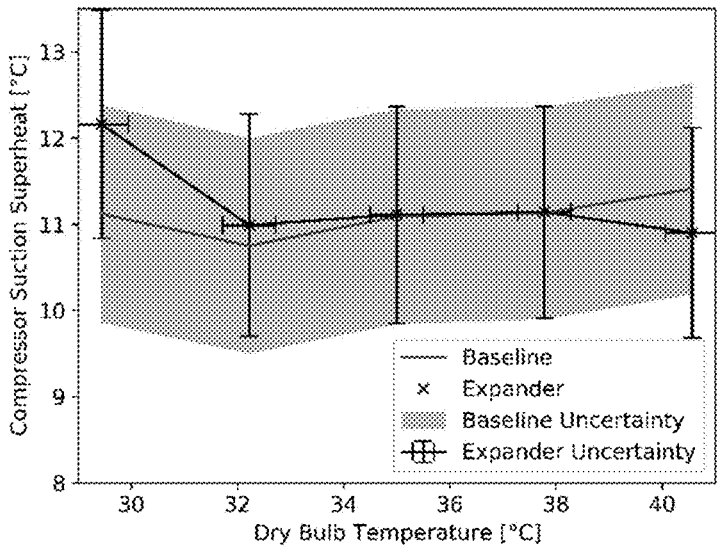
FIG. 10 illustrates suction superheat variation using 1.65 mm elliptical nozzle as a function of outdoor temperature.
Figure 11:
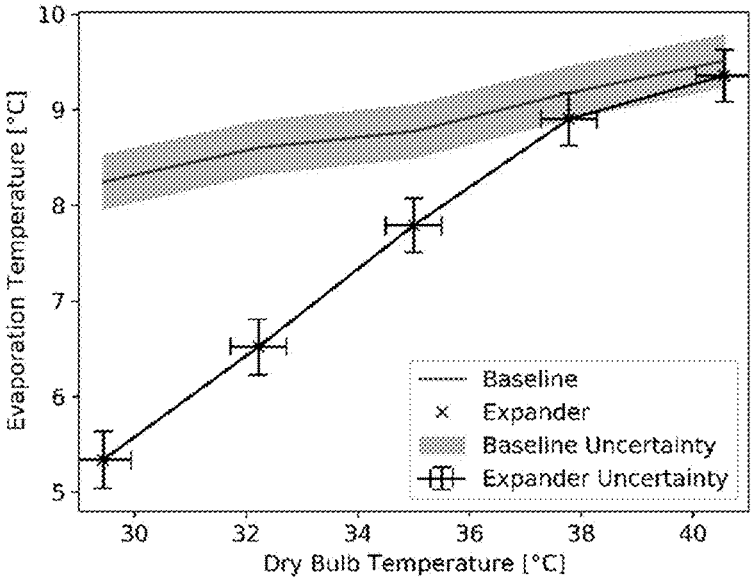
FIG. 11 illustrates evaporation temperature variation using 1.65 mm elliptical nozzle as a function of outdoor temperature.
Figure 12:
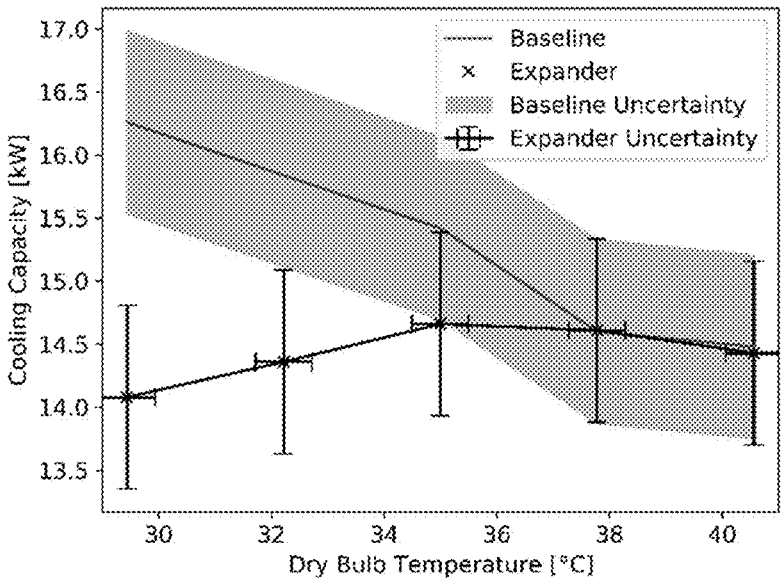
FIG. 12 illustrates cooling capacity variation using 1.65 mm elliptical nozzle as a function of outdoor temperature.
Figure 13:
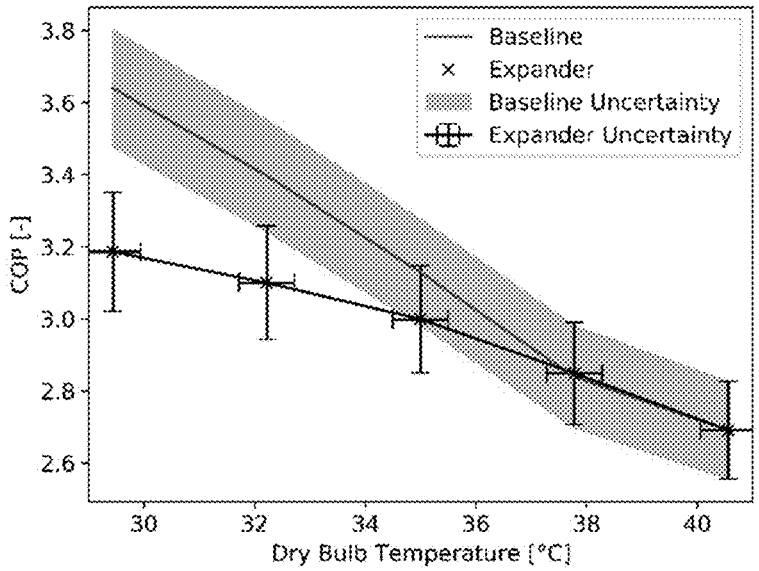
FIG. 13 illustrates COP variation using 1.65 mm elliptical nozzle as a function of outdoor temperature.

The superheat comparison over the range of outdoor temperatures showed the ability of varying the vapor bypass flow rate to maintain superheat values at or within 1° C. of the TXV cycle superheat for all points tested, shown in FIG. 10. Despite the airside conditions being held constant between the TXV and expander tests, the evaporation temperature is up to 3° C. lower with the expander than with the TXV, as shown in FIG. 11. Furthermore, FIG. 12 shows that the cooling capacity is significantly lower, more than 10% in some cases, with the expander than with the TXV. These two points suggest that the nozzle throat diameter is smaller than is needed by the TXV at the same conditions, resulting in excess throttling. This leads to a larger pressure drop across the nozzle as well as a reduced mass flow rate, both of which would agree with the points mentioned regarding the evaporation temperature and capacity comparison. FIG. 13 provides the COP comparison between expander and TXV mode, showing a decrease in COP with the expander relative to the TXV mode until the outdoor temperature reached 40° C. The heater was not applied in the 1.65 mm nozzle testing because compressor suction superheat was above that of the TXV at the same conditions before opening the bypass valve.

If the auxiliary heater were applied for this testing, the projected cooling capacity increase of 576 W during expander operation would also lead to an increase in compressor suction superheat, thus allowing for an increased number of turns from the bypass valve to create more expander output power. The EES code used to post-process the experimental data was modified to simulate the application of this auxiliary heat, and the resulting suction superheat increase was 5.4° C. to 5.6° C. across the points tested. This shows that, even if the bypass nozzle is completely opened, the superheat could only be reduced to within 1° C. of the target superheat in the most extreme condition. This conclusion was reached by quantifying the change in superheat achievable per metering valve rotation, resulting in 0.5° C. per rotation. Given a maximum of 9.5 turns, this results in a maximum decrease in superheat of 4.75° C. The resulting power increase from the expander would be a maximum of 18.1 W, calculated by the same principle at 1.9 W per turn. While this increased power makes the device more desirable, the lack of matching superheat values makes inclusion of this value into a COP comparison less meaningful. If the auxiliary heat on the vapor bypass line was utilized during this testing it was calculated that a COP benefit of 4% could be achieved at outdoor temperatures at or above 37° C. while also using a nozzle that would allow for compressor suction superheat control. Therefore, the calculated COP projection includes only the increased cooling capacity from the auxiliary heater, thus representing a conservative estimate of the device COP benefit. The expander overall isentropic efficiency reached a maximum value of 14.3% using the 1.65 mm nozzle, with turbine rotational velocity ranging from 3900 to 4800 RPM.

A COP improvement of 2.3% was achieved at Test Condition A using the 2.29 mm straight nozzle, while the COP decreased by 4.3% at the same test condition with the 1.65 mm elliptical nozzle, showing that the smaller nozzle significantly hindered expander performance. Additionally, adequate compressor suction superheat control was achieved without utilizing the auxiliary heater with the 1.65 mm nozzle, whereas the suction superheat was an average of 4° C. lower than the TXV mode when using the 2.29 mm nozzle with the auxiliary heater. Therefore, it can be concluded that there exists a nozzle size in between the two presented in this comparison that would enable adequate compressor suction superheat control while also providing a COP benefit.

4. CONCLUSIONS

This disclosure presents theoretical and experimental analyses of the performance benefits of an expander in an R-410A residential split system heat pump. The theoretical analysis compared COP benefits of the expander in both cooling and heating mode to identify the mode which should be experimentally tested for the greatest expander benefit. Prototypes of the expander were fabricated, and the 5-ton split system heat pump experimental setup used for expander testing was described. A method for controlling the expander over a range of operating conditions was assessed in the experimental setup, and its performance effects and control ability were quantified and discussed.

The theoretical analysis motivated experimental operation of the heat pump in cooling mode. This conclusion is supported by the analysis resulting in simulated COP improvements from 4.5% to 6.9% and 7.2% to 15.3% in heating and cooling modes, respectively.

The control method assessed was utilizing the expander as a combined expander-phase separation device to allow both expansion-work recovery and open economization in the system. Control was achieved by varying the flow rate of vapor bypass around the evaporator. This enabled the ability to increase expander power by decreasing friction on the turbine as well as to maintain a safe and constant compressor suction superheat. A maximum COP benefit of 2.3% was reached after calculations correcting for superheat variations between the expander and TXV test points, and the expander reached an overall isentropic efficiency of 18.8%. Increasing the flow rate of the evaporator bypass increased the expander power output by 16.5% and decreased pressure drop through the evaporator distributor by over 5% due to lower quality flow exiting the liquid outlet of the expander while retaining safe compressor suction superheat. Over outdoor dry bulb temperatures ranging from 30° C. to 40° C., the vapor bypass metering was able to match the TXV suction superheat to within 1° C. However, the nozzle used to maintain this control was undersized, thus constraining the system mass flow rate and decreasing the evaporation pressure to an extent that caused a decrease in COP relative to the TXV. If the auxiliary heat on the vapor bypass line was utilized during this testing it was calculated that a COP benefit of 4% could be achieved at outdoor temperatures at or above 37° C. while also using a nozzle that would allow for compressor suction superheat control. In addition, this suggests that the nozzle was undersized for this parametric test, offering a promising conclusion that with the auxiliary heater and a larger nozzle the COP benefit of 4% could be both increased and obtained at lower outdoor temperatures, while simultaneously offering adequate compressor suction superheat control. In practice, the auxiliary heat input could be obtained through an additional evaporator circuit.

| NOMENCLATURE | | |
|---|---|---|
| F | Superheat correction factor | (-) |
| h | Specific enthalpy | (kJ $kg^{-1}$) |
| $k_v$ | Flow coefficient | ($m^3$ $h^{-1}$) |
| $\dot{m}$ | Mass flow rate | (kg $s^{-1}$) |
| N | Speed | (rev $min^{-1}$) |
| P | Pressure | (kPa) |

-continued

| NOMENCLATURE | | |
|---|---|---|
| $\dot{Q}$ | Heat Transfer Rate | (kW) |
| RH | Relative humidity | (%) |
| T | Temperature | (° C.) |
| U | Uncertainty | (units vary) |
| W | Power | (kW) |
| | Greek symbols | |
| Δ | Change | (units vary) |
| η | Efficiency | (%) |
| Ω | Resistance | (Ohm) |
| ρ | Density | (kg $m^{-3}$) |
| | Acronyms | |
| AC | Alternating Current | |
| COP | Coefficient of Performance | |
| $CO_2$ | Carbon Dioxide | |
| C-D | Converging-Diverging | |
| DC | Direct Current | |
| ECM | Electronically Commutated Motor | |
| EES | Engineering Equation Solver | |
| EXV | Electronic Expansion Valve | |
| FS | Full Scale | |
| HFC | Hydrofluorocarbon | |
| RPM | Revolutions per Minute | |
| TXV | Thermostatic Expansion Valve | |
| VCC | Vapor Compression Cycle | |
| | Subscript | |
| 1,2,3 . . . | State Points | |
| Cond | Condenser | |
| Comp | Compressor | |
| Evap | Evaporator | |
| Exp | Expander | |
| o | Overall | |
| s, is | Isentropic | |
| X | Measured Quantity | |
| Y | Calculated Quantity | |

Those skilled in the art will recognize that numerous modifications can be made to the specific implementations described above. The implementations should not be limited to the particular limitations described. Other implementations may be possible.

We claim:

1. A method for operating and controlling a vapor-compression cycle, wherein the method comprises:

providing a system comprising an evaporator with a fan, an inlet, and an outlet; a compressor with an inlet and an outlet; a condenser with a fan, an inlet and an outlet; an integrated expander and flash tank device with a vapor/liquid two-phase inlet and two outlets, wherein a first outlet is a vapor outlet and a second outlet is a liquid outlet; and a metering valve with an inlet and an outlet, wherein the metering valve is disposed between the vapor outlet of the integrated expander and flash tank device, the inlet of the compressor, and the outlet of the evaporator;

bringing a vapor-compression cycle up to steady-state at a fixed operating condition by first turning on the evaporator fan, then turning on the compressor, and the condenser fan, and keeping the metering valve closed, wherein the steady-state is determined by evaporator and condenser air outlet temperature variations of not greater than 1.1° C.;

beginning to open the metering valve to bypass vapor from the flash tank of the integrated expander and flash tank device towards the inlet of the compressor;

continuing to open the metering valve until a desired degree of suction superheat at the compressor is achieved; and maintaining the desired degree of superheat by selectively increasing or decreasing superheat, wherein increasing superheat includes reducing the metering valve flow rate, and decreasing superheat includes increasing the metering valve flow rate.

2. The method of claim 1, wherein a heater is provided downstream of the metering valve to ensure compressor suction superheat.

3. The method of claim 1, wherein the expander is a turbine-based expander.

4. The method of claim 3, wherein the turbine is a radial-in axial-out turbine.

5. The method of claim 1, wherein the method further comprises:

mixing the vapor from the vapor outlet of the expander with superheated vapor from the outlet of the evaporator to thereby decrease compressor suction superheat;

feeding a lower quality liquid from the flash tank into the evaporator to thereby decrease pressure drop and refrigerant maldistribution through an evaporator distributor;

varying the flow rate of the vapor bypass around the evaporator to thereby reduce friction on the expander and enhance expander power output.

* * * * *